US006606983B2

(12) United States Patent
Bedwell et al.

(10) Patent No.: US 6,606,983 B2
(45) Date of Patent: Aug. 19, 2003

(54) FERROUS PISTONS FOR DIESEL ENGINES HAVING EGR COATING

(75) Inventors: Tom Bedwell, Ann Arbor, MI (US); Carmo Ribeiro, Ann Arbor, MI (US); Miguel N. D. De Azevedo, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/954,842

(22) Filed: Sep. 18, 2001

(65) Prior Publication Data

US 2003/0051714 A1 Mar. 20, 2003

(51) Int. Cl.[7] ..... F02B 51/02
(52) U.S. Cl. ..... 123/670
(58) Field of Search ..... 123/670, 193.6, 123/668, 669, 193.1, 193.5, 193.3, 193.4, 192.2; 92/223; 29/888.043, 888.048, 888.049, 888.074

(56) References Cited

U.S. PATENT DOCUMENTS

| | | | | |
|---|---|---|---|---|
| 1,975,818 A | | 10/1934 | Work | |
| 3,285,717 A | | 11/1966 | Fischer | |
| 3,911,891 A | | 10/1975 | Dowell | |
| 3,914,574 A | | 10/1975 | Hill et al. | |
| 3,976,809 A | | 8/1976 | Dowell | |
| 4,218,494 A | | 8/1980 | Belmondo et al. | |
| 4,409,947 A | * | 10/1983 | Yanagihara et al. | 123/568.11 |
| 5,257,603 A | | 11/1993 | Bauer et al. | |
| 5,450,784 A | | 9/1995 | Shureb | |
| 5,534,358 A | | 7/1996 | Troup-Packman | |
| 5,713,129 A | | 2/1998 | Rastegar et al. | |
| 5,724,933 A | | 3/1998 | Silvonen et al. | |
| 5,743,012 A | | 4/1998 | Adams et al. | |
| 5,975,040 A | | 11/1999 | Silvonen et al. | |
| 6,044,819 A | | 4/2000 | Rivers et al. | |
| 6,099,624 A | | 8/2000 | Martyak | |
| 6,148,785 A | | 11/2000 | Rivers et al. | |
| 6,435,077 B1 | * | 8/2002 | Damour et al. | 92/187 |
| 6,508,240 B1 | * | 1/2003 | Bedwell et al. | 123/668 |

FOREIGN PATENT DOCUMENTS

| | | | | |
|---|---|---|---|---|
| FR | 2603661 A | * | 3/1988 | F02F/3/12 |
| JP | 58-144656 A | * | 8/1983 | 123/193.6 |

* cited by examiner

*Primary Examiner*—Henry C. Yuen
*Assistant Examiner*—Hyder Ali
(74) *Attorney, Agent, or Firm*—Howard & Howard

(57) ABSTRACT

A corrosion resistant piston for use in an exhaust gas recirculation diesel engine. The piston includes a crown portion having ring grooves formed around a periphery of the crown portion. The ring grooves are separated by ring lands. The piston also includes a piston rod connecting portion that extends from the crown portion. The piston is made of steel and includes an electroless coating of nickel having a maximum thickness of 8 micrometers.

20 Claims, 2 Drawing Sheets

FERROUS PISTONS FOR DIESEL ENGINES HAVING EGR COATING

BACKGROUND OF THE INVENTION

1. Technical Field

The present invention relates generally to pistons for diesel engine application, and particularly to, pistons for use in diesel engine applications utilizing an exhaust gas recirculation system.

2. Related Art

Diesel engines are widely utilized for providing power for trucks, ships and construction machines as well as for use in electrical power generation. In an effort to abate air pollutants such as nitrogen oxides ($NO_x$) present in exhaust gases produced by diesel engines, government regulations may soon require the recirculation of exhaust gases in diesel engines. An exhaust gas recirculation system (EGR) may be utilized as a means of controlling $NO_x$ emissions, but also produces an environment within the engine that is characterized by increased corrosive potential compared to a non-EGR combustion system. Such an EGR system would likely introduce organic acids and other corrosive elements into the combustion chamber and could present a corrosive environment that would be harmful to conventional ferrous pistons.

U.S. Pat. No. 5,450,784 discloses a piston having an electro-deposited tin-based plating for wear resistance. There is no disclosure as to corrosion resistance to an EGR environment.

It is an object of the present invention to provide a ferrous piston which is resistant to attack by a corrosive EGR environment of a diesel engine.

SUMMARY OF THE INVENTION

A piston for a diesel engine having exhaust gas recirculation(EGR) system comprises a piston body fabricated of ferrous metal and a coating of electroless nickel formed on at least a portion of the piston body providing a continuous, non-porous barrier to the EGR environment.

The piston of the present invention has the advantage of providing a continuous barrier layer or coating that protects the ferrous piston from the corrosive EGR environment.

The piston has the further advantage of providing a continuous barrier layer that does not require additional machining or finishing after the barrier layer has been applied. Because there is no additional machining, the coating remains continuous to protect the piston from the corrosive EGR environment.

The electroless coating can be applied in a uniform, thin layer such that the dimensional tolerances of the piston can be maintained without the use of further finishing operations after the coating has been applied. This arrangement allows for an economical corrosion resistant part to be produced without complex machining of the piston or the cylinder of a diesel engine to accommodate the thickness of a coating.

THE DRAWINGS

These and other features and advantages of the present invention will become more readily appreciated when considered in connection with the following detailed description and appended drawings, wherein.

DETAILED DESCRIPTION

Figure 1:
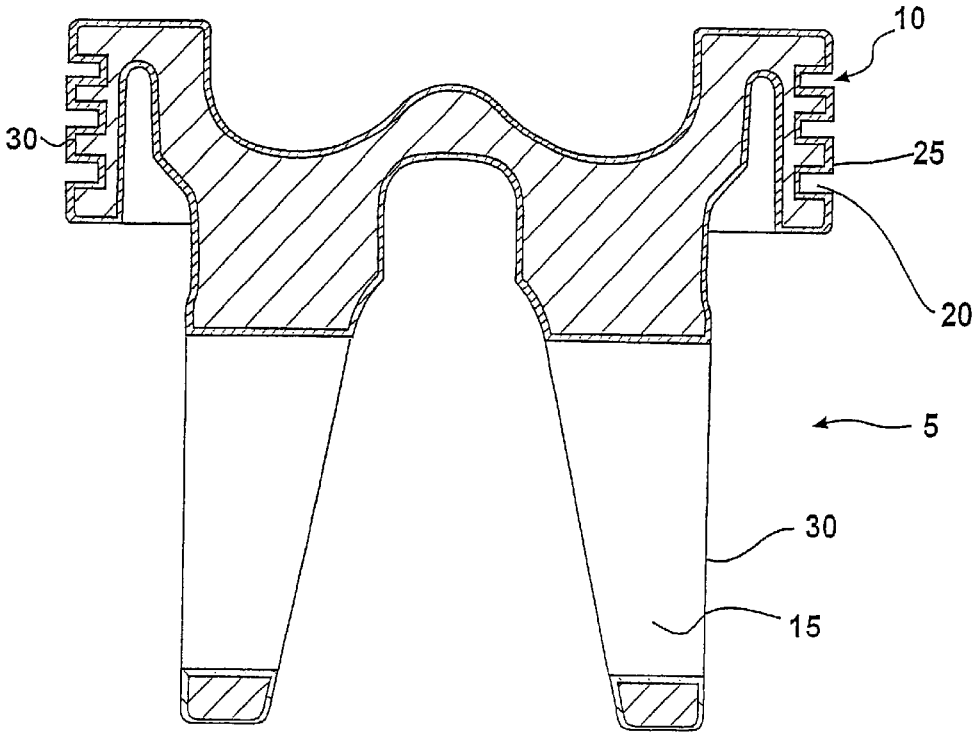
FIG. 1 is a cross section of a piston constructed according to a first embodiment of the present invention.

With reference to FIG. 1, there is shown a first embodiment of the corrosion resistant piston 5 for use in an exhaust gas recirculation(EGR) diesel engine. The piston 5 includes a piston body 10 and a pair of pin bosses 15.

The piston body 10 includes a ring belt 13 having a plurality of ring grooves 20. The ring grooves 20 are separated by a plurality of ring lands 25.

The pin bosses 15 extend downwardly and are integrally formed as one piece with the piston body 10. The piston body 10 is fabricated of ferrous metal, such as steel which is prone to corrosive attack if exposed to the EGR environment of the diesel engine.

In a first embodiment of FIG. 1, the piston body 10 includes an EGR coating 30 formed on a portion of the piston body, including the ring belt 13 and its associated ring grooves 20 and lands 25. The coating 30 comprises an electroless coating of nickel having a maximum thickness of about 8 micrometers. The coating 30 serves as a barrier layer which protects the coated portions of the steel piston body 10 from attack by the corrosive EGR environment.

Electroless nickel plating, also known as chemical or auto catalytic nickel plating, chemically deposits the nickel on the piston body 10 without the use of an external current source (i.e., non-electroplated). The coating operation is based upon the catalytic reduction of nickel ions on the surface being coated electroless nickel deposition applies the EGR coating 30 at a uniform rate and depth and is relatively insensitive to surface geometry, unlike electrolytic plating which varies the current density and thus coating depth and is not capable of applying such a thin, uniform, continuous, non-porous coating as achieved with the electroless coating of the invention. The electroless nickel coating 30 preferably has a thickness ranging from about 3 to 8 micrometers and more preferably of about 5 micrometers. At a thickness of less than about 3 micrometers, the coating 30 does not provide adequate barrier protection to the piston body 10. At thickness greater than about 8 micrometers, the coating interferes with the dimensional tolerancing of the piston body 10 and would require machining or finishing operation after the coating has been applied.

After the coating 30 is applied, no further machining or finishing of the coated surface is conducted, at least in the areas where corrosion protection is desired, such that the coating 30 remains continuous and non-porous to maintain its protective qualities. The piston 5 is machined or finished to its final specifications before the electroless nickel coating 30 is applied. Because of the uniform nature of the electroless nickel coating 30, as well as the relatively thin character of the coating, no further machining or finishing of the coating 30 is required before the piston 5 is installed in an engine.

Figure 2:
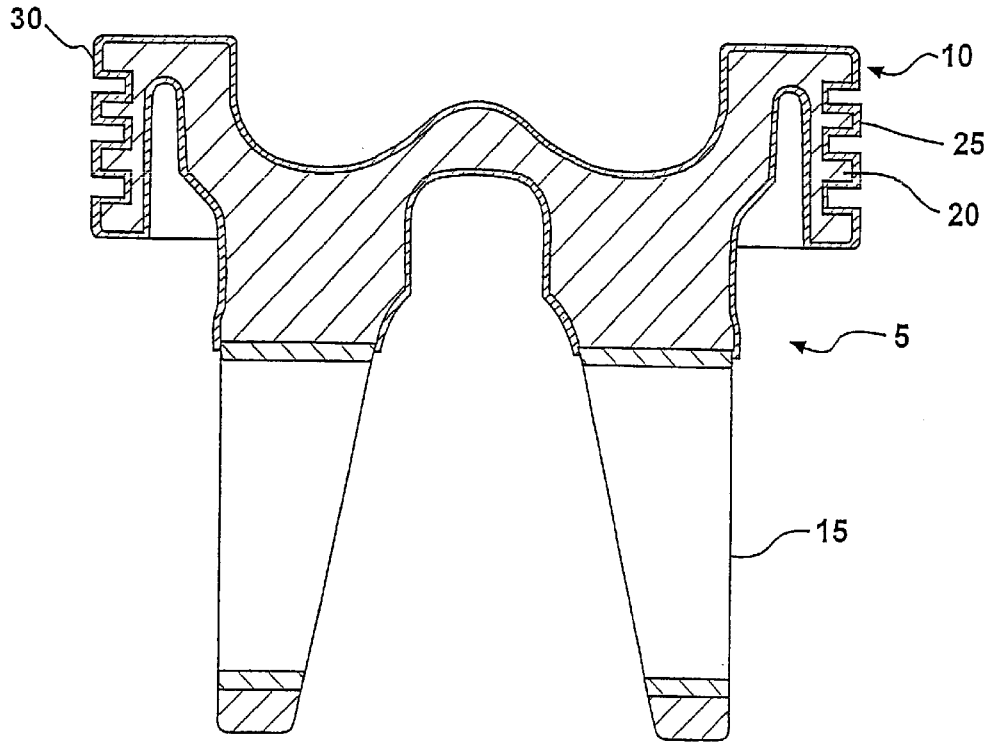
FIG. 2 is a cross section of a piston constructed according to a second embodiment of the present invention.

With reference to FIG. 2, there is shown a second embodiment of the present invention in which the piston 5 is the same as that disclosed in the first embodiment but with the coating 30 applied to the entire piston body 10 including the pin bosses 15.

Figure 3:
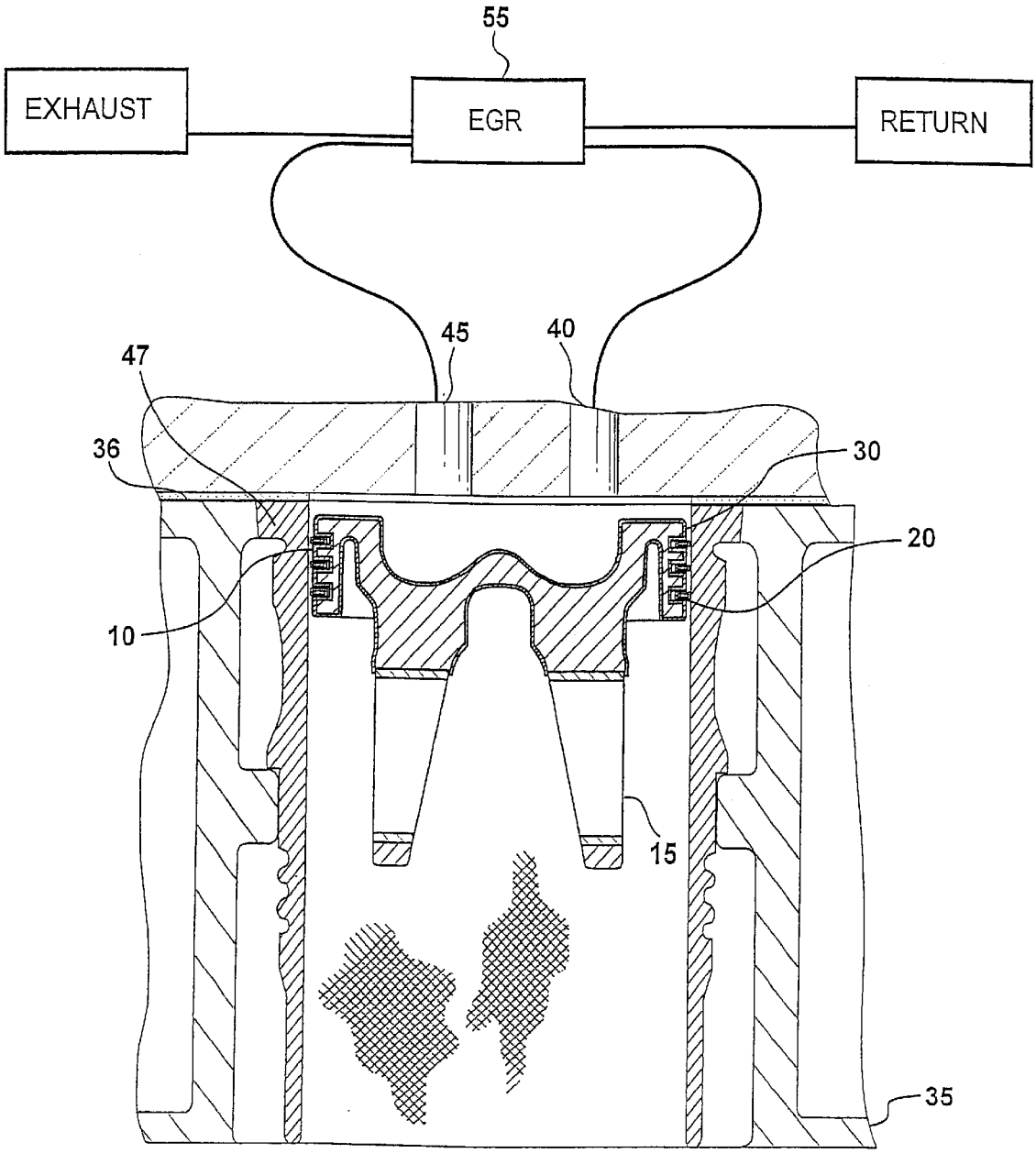
FIG. 3 is a schematic sectional view of a diesel engine having the subject piston.

FIG. 3 shows a diesel engine in which the piston 5 is installed. A cylinder block 35 of the engine includes at least one cylinder in which the piston 5 is accommodated for reciprocation. The block 35 mounts a cylinder head which has intake and exhaust ports 40, 45 communicating with the cylinder. Exhaust gases exiting the exhaust port are processed through the EGR system 55 which recirculates at least a portion of the combusted exhaust gases back into the cylinder for reducing combustion temperature. The EGR environment is corrosive to the ferrous piston 5 and is protected from attack by the coating 30. Other ferrous power cylinder components exposed to the EGR environment are also subject to attack and may be protected by the coating 30 in the same manner described above in connection with the piston 5.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A piston for a diesel engine having exhaust gas recirculation, comprising:

a piston body fabricated of ferrous metal having a plurality of ring grooves and pin bosses; and an EGR coating of electroless nickel formed on at least a portion of said piston body providing a continuous, non-porous barrier to the exhaust gas recirculation environment of the diesel engine.

2. The piston of claim 1 wherein said EGR coating has a maximum thickness of about 8 micrometers.

3. The piston of claim 1 wherein said EGR coating has a ready to use surface finish in its as-applied condition.

4. The piston of claim 1 wherein said piston body includes ring grooves and ring lands between said ring grooves and said EGR coating is applied to said ring grooves and said ring lands.

5. The piston of claim 1 wherein said EGR coating is formed on an entirety of said piston body.

6. The piston of claim 1 wherein said EGR coating has a thickness of about 3 to 8 micrometers.

7. The piston of claim 1 wherein said EGR coating has a thickness of about 5 micrometers.

8. A piston for a diesel engine having exhaust gas recirculation, comprising:

a piston body fabricated of steel having a plurality of ring grooves and ring lands and a pair of pin bosses; and an EGR coating of electroless nickel formed on at least a portion of said piston body having a maximum thickness of about 8 micrometers and providing a continuous, non-porous barrier against the exhaust as recirculation environment of the diesel engine.

9. A method of making a piston for a diesel engine having exhaust gas recirculation, comprising:

fabricating a piston body of ferrous metal;

applying a continuous, non-porous electroless nickel coating to at least a portion of the piston body; and installing the piston body in the diesel engine with the coating in its as-applied condition.

10. The method of claim 9 wherein the coating is applied to an upper ring belt portion of the piston body.

11. The method of claim 9 wherein the coating is applied to an entirety of the piston body.

12. The method of claim 9 wherein the coating is applied to a maximum thickness of about 8 micrometers.

13. The method of claim 9 wherein the coating is applied to a thickness of about 3 to 8 micrometers.

14. The method of claim 9 wherein the coating is applied to a thickness of about 5 micrometers.

15. A diesel engine comprising:

an engine block having a cylinder bore in which exhaust gases are recirculated to provide a corrosive EGR environment;

a ferrous piston disposed in said cylinder bore; and a continuous, non-porous coating of electroless nickel applied to at least a portion of said piston for providing a barrier against said corrosive EGR environment.

16. The diesel engine of claim 15 further including a cylinder liner disposed in said engine block.

17. The diesel engine of claim 15 wherein said coating has a maximum thickness of about 8 micrometers.

18. The diesel engine of claim 15 wherein said coating has a thickness of about 3 to 8 micrometers.

19. The diesel engine of claim 15 wherein said coating has a thickness of about 5 micrometers.

20. A diesel engine comprising:

a combustion chamber;

exhaust gas recirculation directing at least a portion of exhaust gases discharged from said combustion chamber back into said combustion chamber and presenting a corrosive EGR environment within said chamber;

a power cylinder component fabricated of ferrous metal; and an EGR coating of continuous, non-porous electroless nickel applied to at least a portion of said component providing a protective barrier shielding said component from exposure to said EGR environment.

* * * * *

UNITED STATES PATENT AND TRADEMARK OFFICE

CERTIFICATE OF CORRECTION

PATENT NO. : 6,606,983 B2 
DATED : August 19, 2003
INVENTOR(S) : Tom Bedwell, Carmo Ribeiro and Miguel N. D. De Azevedo It is certified that error appears in the above-identified patent and that said Letters Patent is hereby corrected as shown below:

Title page,
Item [75], Inventors, please change the citizenship as follows:

"Carmo Ribeiro", delete "US" and insert therein -- BR --
"Miguel N. D. De Azevedo", delete "US" and insert therein -- BR --

Column 3,
Line 50, please delete "as" and insert therein -- gas --

Signed and Sealed this

Sixteenth Day of March, 2004

JON W. DUDAS
*Acting Director of the United States Patent and Trademark Office*